United States Patent [19]

Burton

[11] 4,252,260

[45] Feb. 24, 1981

[54] NOZZLE ASSEMBLY

[75] Inventor: Stanley J. Burton, Leigh-on-Sea, England

[73] Assignee: Fisco Products Limited, Rayleigh, England

[21] Appl. No.: 14,985

[22] Filed: Feb. 26, 1979

[30] Foreign Application Priority Data

Mar. 3, 1978 [GB] United Kingdom ..... 8522/78

[51] Int. Cl.[3] ..... B25C 1/00; B25C 3/00; B25C 7/00

[52] U.S. Cl. ..... 227/119; 227/139; 227/149

[58] Field of Search ..... 227/119, 139, 149, 9, 227/10, 114

[56] References Cited

U.S. PATENT DOCUMENTS

| | | | |
|---|---|---|---|
| 2,796,608 | 6/1957 | Johnson | 227/114 |
| 2,874,383 | 2/1959 | Wieneke | 227/149 X |
| 3,521,398 | 7/1970 | Coutts | 227/149 |
| 3,764,054 | 10/1973 | Monacelli | 227/114 |

FOREIGN PATENT DOCUMENTS

| | | | |
|---|---|---|---|
| 1136523 | 5/1957 | France | 227/149 |

*Primary Examiner*—Paul A. Bell

*Attorney, Agent, or Firm*—McCormick, Paulding & Huber

[57] ABSTRACT

A nozzle assembly for a nail gun includes a nozzle barrel 2 which is frictionally and rotatably coupled to a nozzle holder 10. The nozzle barrel 2 includes a nail guiding portion 4 having formed on it a cut-away part 24 and a flat 26. In operation, the barrel 2 is rotated so that if necessary the part 24 and flat 26 fit over an adjacent nail head or projection.

12 Claims, 2 Drawing Figures

NOZZLE ASSEMBLY

TECHNICAL FIELD

The present invention relates to a nozzle assembly, and is particularly concerned with but not restricted to a nozzle assembly for guiding large-headed nails. In this Specification, by "large-headed nails" is meant nails having a head which is relatively large compared to the relatively thin nail stem. One example of such a large-headed nail is an upholsterer's nail having a large nearly hemispherical head and a relatively short pointed stem.

PRIOR ART

Upholsterer's nails can be driven into the appropriate frame or support part of upholstery by using what is known as a nail gun. By "nail gun" is meant a nail driving device having at its outlet a nozzle assembly which is held against the appropriate frame or support part about to receive a nail. In operation, the nails are driven in sequence by a driving tool from the interior of the gun through its outlet nozzle assembly into the upholstery. It is frequently desirable to be able to drive in the nails so as to be either close to one another or close to a projecting portion of the upholstery. With previously proposed nail guns, the problem arises that when carrying out this "close nailing" the nozzle assembly of the gun tends to foul either an adjacent driven nail or the projecting frame or support part.

STATEMENT OF INVENTION AND ADVANTAGES

It is an aim of the invention to alleviate the aforementioned difficulty, and accordingly there is provided a nozzle assembly comprising a nozzle barrel frictionally and rotatably coupled to a nozzle holder, in which the nozzle barrel has an identifiable feature located at a specific radial region of the barrel whereby on rotating the barrel with respect to the holder, the feature can be located at a desired radial location on the assembly.

By "frictionally and rotatably coupled" is meant that the barrel is readily rotatable with respect to the nozzle holder but will remain in a position to which it has been set until it is again rotated by an operator.

In a preferred nozzle assembly of the invention, the barrel can be frictionally and rotatably mounted on the nozzle holder, and can be retained in position on the holder by means of a spring. If desired, there can be a plurality of readily identifiable features each located at a specific radial region of the nozzle barrel.

FIGURES IN THE DRAWINGS

One embodiment of the invention will now be described by way of example with reference to the accompanying illustrative drawing in which:

FIG. 1 is a sectional elevation partly in section of one nozzle assembly of the invention having two identifiable features located thereon, and FIG. 2 is an elevation of part of the nozzle assembly of FIG. 1 with the identifiable features located at a different relative radial position.

DETAILED DESCRIPTION OF DRAWINGS

Figure 1:
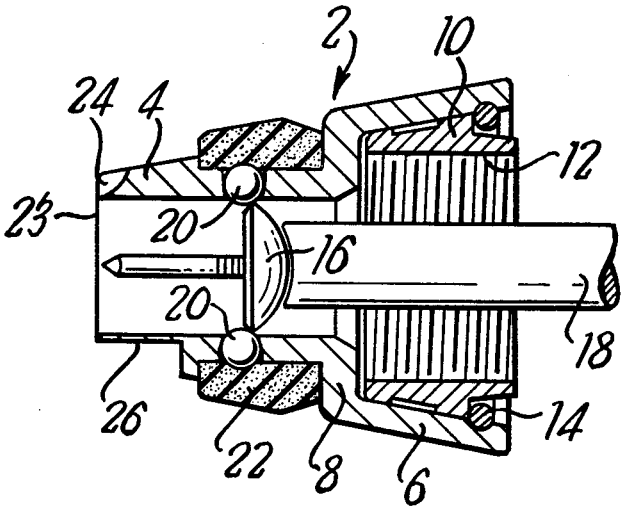

Referring to the drawings, one nozzle assembly of the invention includes a tubular nozzle body 2 consisting of a nail guiding portion 4, and a mounting portion 6 extending from opposite sides of an intermediate step 8. The guiding portion 4 is of constant internal diameter, and the mounting portion 6 tapers towards the intermediate step 8.

A tubular nozzle holder 10 is internally screw-threaded at 12 for attachment to the main body of a nail gun (not shown). The holder 10 has an external surface of the same taper as the internal surface of the mounting portion 6, and the holder 10 is retained in the mounting portion 6 by a circular spring clip 14 which is located in a groove in the internal surface of the mounting portion 6. The mounting portion 6, the holder 10 and the spring 14 are dimensioned and arranged so that the nozzle body 2 is readily rotatable on the holder 10, and will remain in any set position until it is again rotated by an operator. It is found that the aforementioned tapering of the portion 6 and holder 10 provides sufficient friction to prevent unwanted rotation of the body 2 with the minimum pressure from the spring 14. This aforementioned tapering also temporarily locks the holder 10 to the body 2 when pressure is applied to the nozzle assembly on firing a nail.

The internal diameter of the nail guiding portion 4 is slightly greater than the greatest diameter of a nail head 16 to enable a nail to be propelled through the portion 4 by a driven member 18 on firing the nail. Three or more hardened balls 20 are retained in respective symmetrically positioned holes in the guiding portion 4 by means of a rubber collar 22 which makes a firm fit in a recessed part of the portion 4. The ends of the holes adjacent to the internal surface of the portion 4 are turned inwardly to prevent the balls 20 from entering the bore of the portion 4.

As will be seen from FIG. 1, when a nail is in its firing position it is located in the bore of the portion 4 with the head 16 resting on the balls 20 and with the drive member 18 in its retracted position. To fire the nail, the forward face 23 of the portion 4 is pressed against a part of the upholstery to receive the nail, and the drive member 18 is rapidly advanced by pneumatic pressure to force the nail head past the balls 20 and to drive the nail into the upholstery. It will be appreciated that the balls 20 are able to move apart to allow passage of the nail head 16 due to the resilience of the rubber collar 22.

A part 24 is cut-away from the guiding portion 4 near to its forward face 23. This part 24 is complementary to a rim portion of the nail head 16 where its domed surface meets its flat surface. In addition, a flat 26 is cut into the guiding portion 4 diammetrically opposite to the cut-away part 24.

In order to drive in a plurality of nails in close proximity to one another, the nozzle body 2 is manually rotated by the operator so that when the forward face 23 is placed over the portion of the upholstery to receive the next nail, the cut-away part 24 fits over the nearest part of an adjacent nail head 16. Similarly, in order to drive in a nail adjacent to a projecting part or member, the nozzle body 2 is rotated so that when the forward face 23 is over the nail driving region the flat 26 fits over the said projecting part.

In this way it is possible to drive in nails in close proximity either to one another or to a projecting part while at the same time keeping the entire forward face 23 pressed flat against the part of the upholstery to receive a nail to be driven.

With previously proposed nozzle assemblies, it has been necessary to provide a multiplicity of cut-out parts or flats to enable the direction of nailing to be changed without changing the position of the gun. This has the disadvantage that the forward portion of the nozzle may become structurally weak, and that the area of the forward face 23 is seriously reduced thereby leaving pointed regions that can mark or damage the upholstery when pressure is applied to the nozzle assembly on firing.

Some previously proposed nozzle assemblies are screwed into a fixed position onto a nail gun. Consequently the cut-outs and/or flats have to be accurately formed so that they are in the correct position relative to the nail gun when the nozzle assembly is screwed into position. An advantage of the described and illustrated nozzle assembly is that this accurate positioning of the cut-outs and flats is not necessary because the nozzle body 2 can be rotated to any desired position after the nozzle assembly is mounted on the nail gun. This also means that the nozzle assemblies of the invention are readily interchangeable on a nail gun.

Figure 2:
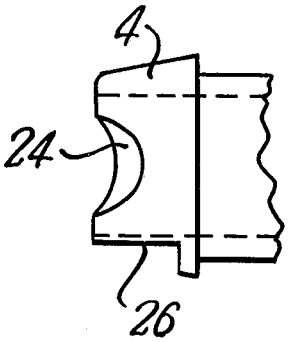

In the nozzle assembly of FIG. 1, the cut-away part 24 and the flat 26 constituting the identifiable features of the assembly are located diametrically opposite to one another. It is to be understood that the assembly of the invention can include any number of identifiable features which can be located at any desired relative radial position. For example, FIG. 2 illustrates part of a nail guiding portion 4 on which is formed a cut-away part 24 and a flat 26 located at right angles to one another.

The described and illustrated nozzle body 2 and nail guiding portion 4 are made of a good quality high-carbon high-chrome steel, although it is to be understood that any suitable materials may be used.

I claim:

1. A nozzle assembly comprising a tubular nozzle holder having a tapered external surface, a tubular nozzle body including a guiding portion having an identifiable feature located at a specific radial region thereof, said nozzle body including a mounting portion frictionally and rotatably mounted on said nozzle holder and having a tapered internal surface frictionally engaging and complementing said external surface, and spring means disposed internally of said mounting portion for retaining said nozzle body in assembly with said nozzle holder and urging said internal and external surfaces toward frictional engagement whereby on rotating the nozzle body with respect to the holder said feature can be located at a desired radial location on said assembly.

2. An assembly as claimed in claim 1, including a plurality of balls circumferentially spaced around the guiding portion, and annular resilient means urging said balls inwardly of the guiding portion inner wall to retain a nail in the guiding portion until it is fired.

3. An assembly as claimed in claim 1, in which the nozzle body includes an intermediate step and said guiding portion is connected to said mounting portion by said intermediate step.

4. An assembly as claimed in claim 3, in which the mounting portion tapers towards said step.

5. An assembly as claimed in any one of claims 1, 3 and 4, in which said spring means comprises a spring clip extending circumferentially around the internal surface of the mounting portion to project inwardly from said internal surface.

6. An assembly as claimed in claim 5, in which the spring means is located in a groove in the said internal surface.

7. An assembly as claimed in any one of claims 1, 3 and 4, in which the said identifiable feature is a cut-away part.

8. An assembly as claimed in any one of claims 1, 3 and 4, in which the said identifiable feature is a flat.

9. An assembly as claimed in any one of claims 1, 3 and 4, including a plurality of said identifiable features.

10. An assembly as claimed in claim 9, including two identifiable features located diametrically opposite to one another.

11. An assembly as claimed in claim 9, including two identifiable features located at right angles to one another.

12. An assembly as claimed in any one of claims 1, 3 and 4, in which the nozzle body is made of high-carbon high-chrome steel.

* * * * *